US012600555B1

(12) United States Patent
Shaffer

(10) Patent No.: US 12,600,555 B1
(45) Date of Patent: Apr. 14, 2026

(54) SOAP OR SHAMPOO BOTTLE THAT CONVERTS INTO A TOY

(71) Applicant: Candice Shaffer, Millersville, MD (US)

(72) Inventor: Candice Shaffer, Millersville, MD (US)

( * ) Notice: Subject to any disclaimer, the term of this patent is extended or adjusted under 35 U.S.C. 154(b) by 0 days.

(21) Appl. No.: 18/761,507

(22) Filed: Jul. 2, 2024

(51) Int. Cl.

| | |
|---|---|
| ***B65D 81/36*** | (2006.01) |
| ***A63H 17/00*** | (2006.01) |
| ***A63H 17/26*** | (2006.01) |
| ***B65D 1/02*** | (2006.01) |
| ***B65D 23/12*** | (2006.01) |
| ***B65D 41/04*** | (2006.01) |

(52) U.S. Cl.
CPC ..... *B65D 81/365* (2013.01); *A63H 17/002* (2013.01); *A63H 17/262* (2013.01); *B65D 1/0223* (2013.01); *B65D 23/12* (2013.01); *B65D 41/04* (2013.01); *B65D 2501/0081* (2013.01)

(58) Field of Classification Search
CPC .... B65D 81/365; B65D 1/0223; B65D 23/12; B65D 41/04; B65D 2501/0081; A63H 17/002; A63H 17/262
USPC ..... 206/216
See application file for complete search history.

(56) References Cited

U.S. PATENT DOCUMENTS 1,586,608 A * 6/1926 Carver ..... A63H 17/004 446/431
3,246,420 A 4/1966 Douglas
3,512,301 A 5/1970 Kramer
4,631,040 A * 12/1986 Shiraishi ..... A63H 17/002 446/124
4,895,542 A * 1/1990 de Blanitza ..... A63H 17/26 446/471
4,969,851 A * 11/1990 Rasmussen ..... A63H 18/028 446/470
5,738,232 A * 4/1998 Roberts ..... B65D 41/04 215/44
D426,893 S 6/2000 Pfiffner
D430,301 S 8/2000 Pfiffner
6,138,402 A * 10/2000 Wotton ..... A01M 1/106 43/107
6,176,755 B1 * 1/2001 Bye ..... A63H 17/002 446/77
6,488,556 B2 * 12/2002 Galomb ..... A63H 11/00 446/73
D682,950 S * 5/2013 Johansson ..... D21/495
(Continued)

FOREIGN PATENT DOCUMENTS

EP 2489605 2/2014

OTHER PUBLICATIONS

Google, Lightning McQueen Bubble Bath, Disney Cars Lightning McQueen Bubble Bath DisneyToyCollection, Toys R Fun, Dec. 26, 2013, https://www.youtube.com/watch?v=GVbcLZrtEN4.*

*Primary Examiner* — Ernesto A Grano
(74) *Attorney, Agent, or Firm* — Kyle A. Fletcher, Esq.

(57) ABSTRACT

The soap or shampoo bottle that converts into a toy is an entertainment. The soap or shampoo bottle that converts into a toy is a container. The soap or shampoo bottle that converts into a toy is configured for use in containing a liquid phase compound. The soap or shampoo bottle that converts into a toy incorporates a bottle structure and a plurality of decorative structures. The plurality of decorative structures attach to the bottle structure. The liquid phase compound is stored within the bottle structure.

14 Claims, 5 Drawing Sheets

(56) References Cited

U.S. PATENT DOCUMENTS

| | | | | |
|---|---|---|---|---|
| 8,528,761 | B2 * | 9/2013 | Yarro | B65D 51/28 215/400 |
| D710,712 | S * | 8/2014 | Yarro | D9/674 |
| 9,016,473 | B2 | 4/2015 | Tamarindo | |
| 10,202,225 | B2 | 2/2019 | Tamarindo | |
| 11,364,448 | B2 * | 6/2022 | Cheung | A63H 17/26 |
| 2005/0014439 | A1 * | 1/2005 | Erickson | A63H 27/001 446/61 |

* cited by examiner

SOAP OR SHAMPOO BOTTLE THAT CONVERTS INTO A TOY

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of other toys. (A63H33/00)

SUMMARY OF INVENTION

The soap or shampoo bottle that converts into a toy is an entertainment. The soap or shampoo bottle that converts into a toy is a container. The soap or shampoo bottle that converts into a toy is configured for use in containing a liquid phase compound. The soap or shampoo bottle that converts into a toy comprises a bottle structure and a plurality of decorative structures. The plurality of decorative structures attach to the bottle structure. The liquid phase compound is stored within the bottle structure.

These together with additional objects, features and advantages of the soap or shampoo bottle that converts into a toy will be readily apparent to those of ordinary skill in the art upon reading the following detailed description of the presently preferred, but nonetheless illustrative, embodiments when taken in conjunction with the accompanying drawings.

In this respect, before explaining the current embodiments of the soap or shampoo bottle that converts into a toy in detail, it is to be understood that the soap or shampoo bottle that converts into a toy is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the soap or shampoo bottle that converts into a toy.

It is therefore important that the claims be regarded as including such equivalent construction insofar as they do not depart from the spirit and scope of the soap or shampoo bottle that converts into a toy. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

Figure 1:
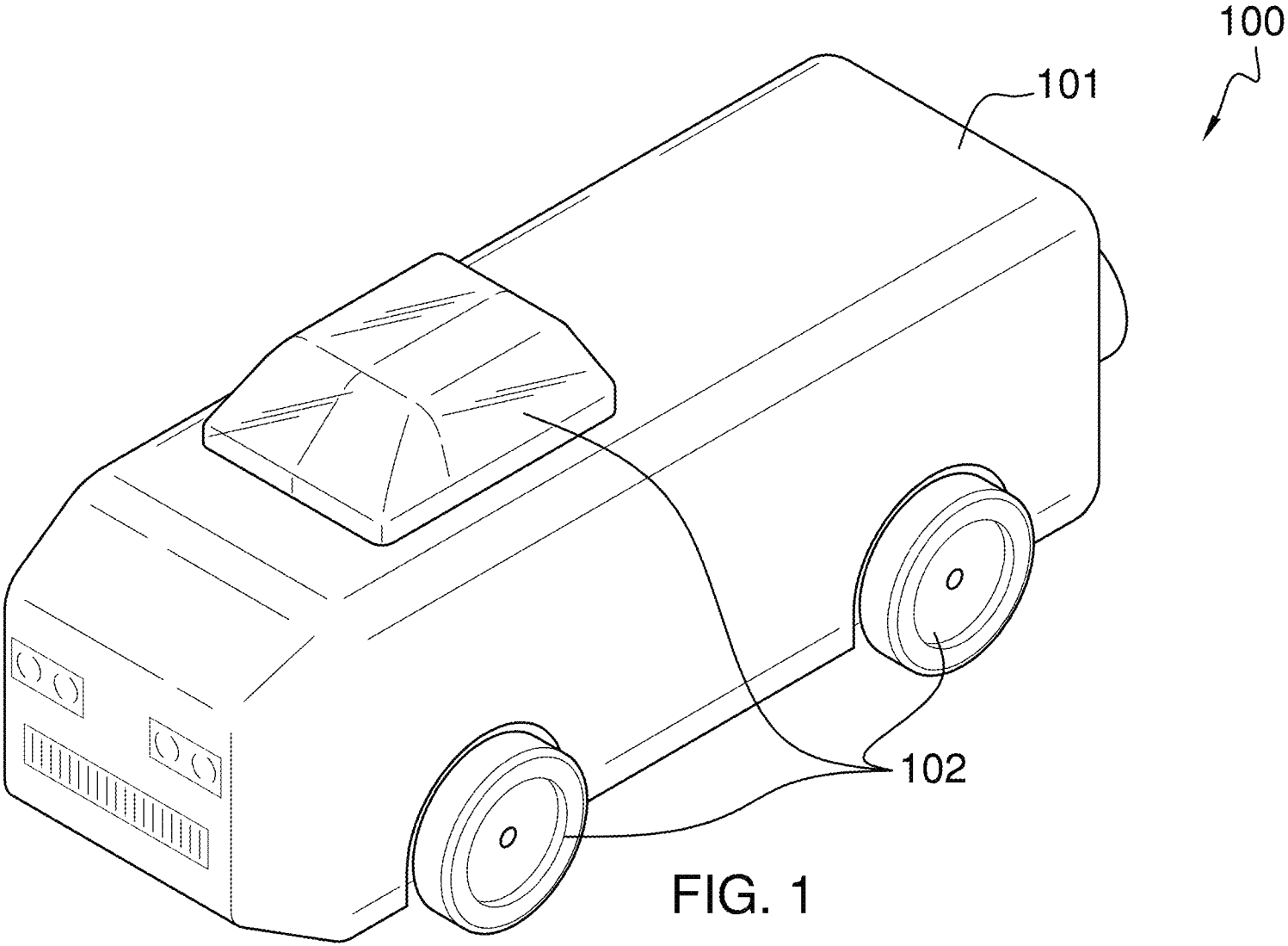
FIG. 1 is a perspective view of an embodiment of the disclosure. 8
Figure 2:
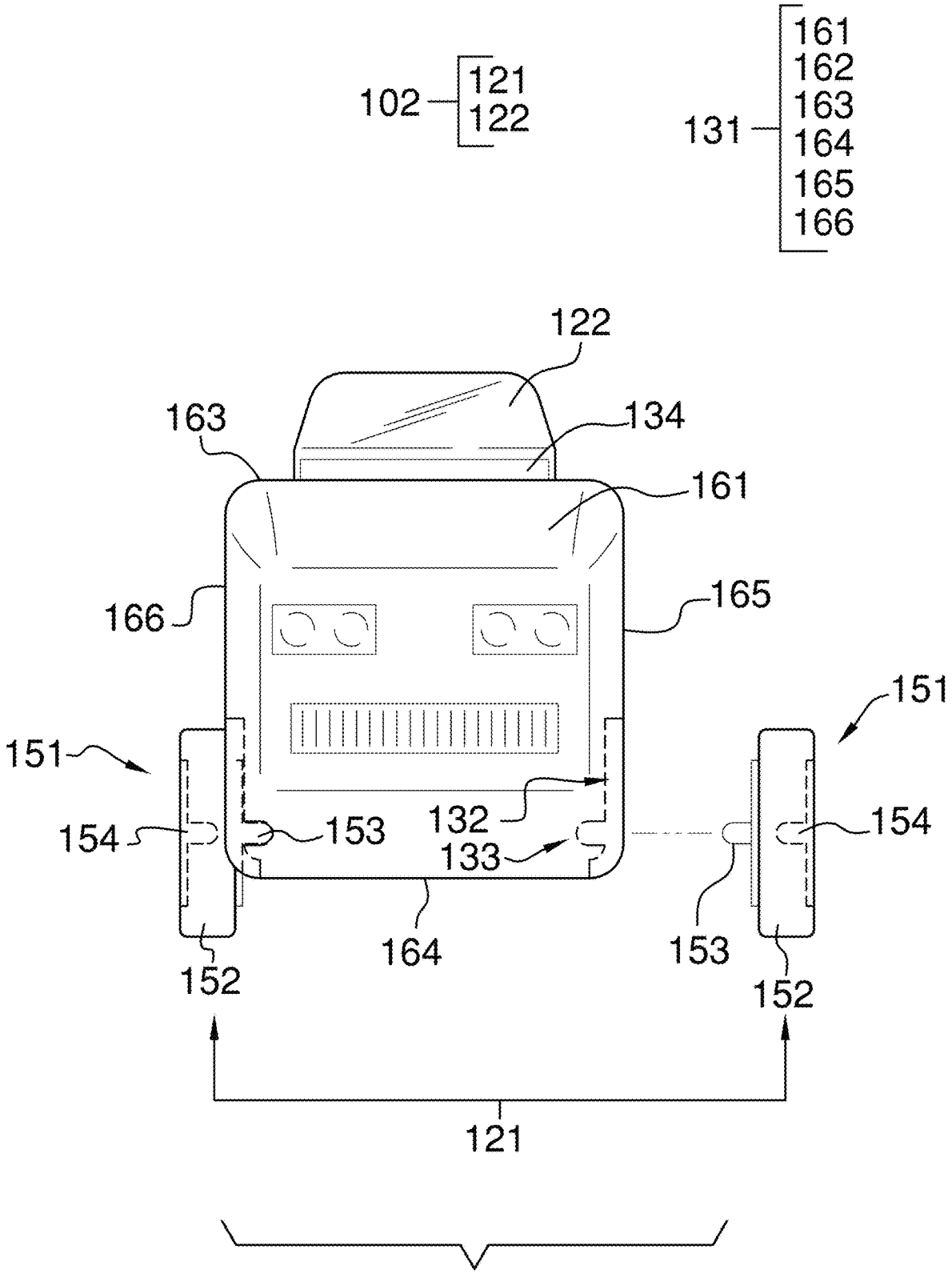
FIG. 2 is an anterior view of an embodiment of the disclosure.
Figure 3:
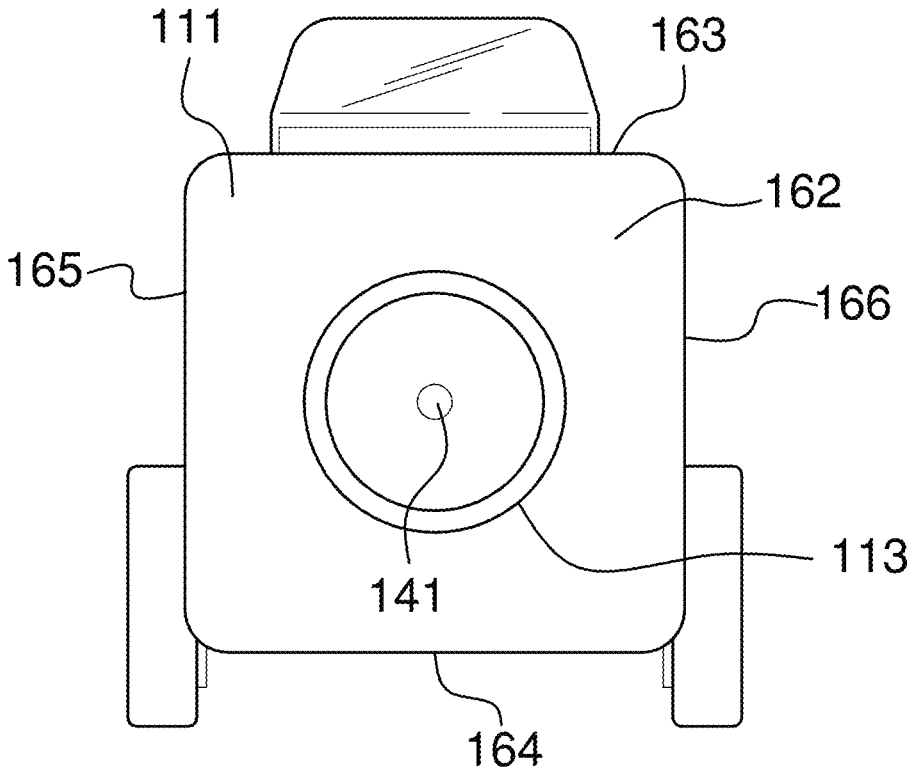
FIG. 3 is a posterior view of an embodiment of the disclosure.
Figure 4:
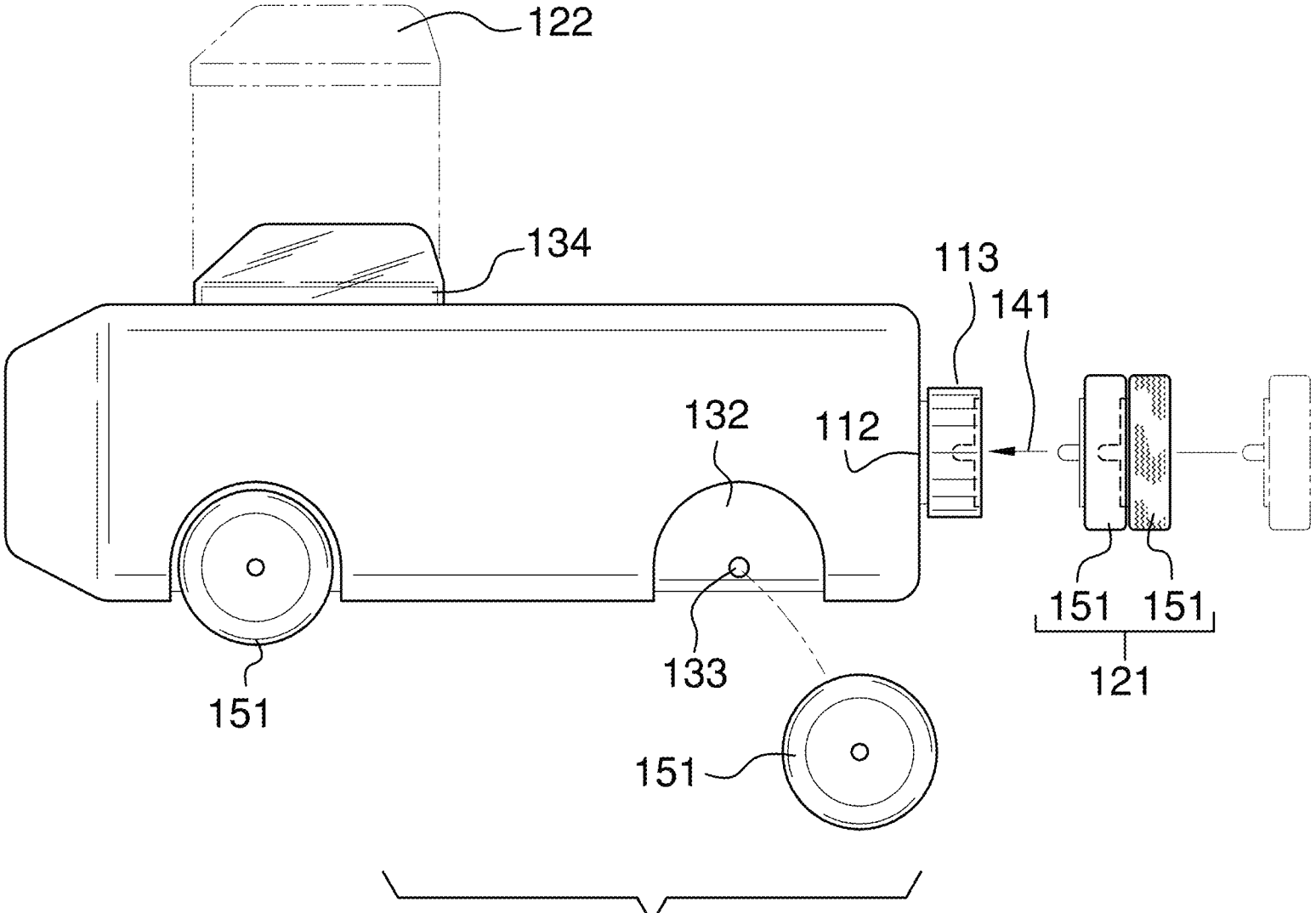
FIG. 4 is an exploded view of an embodiment of the disclosure.
Figure 5:
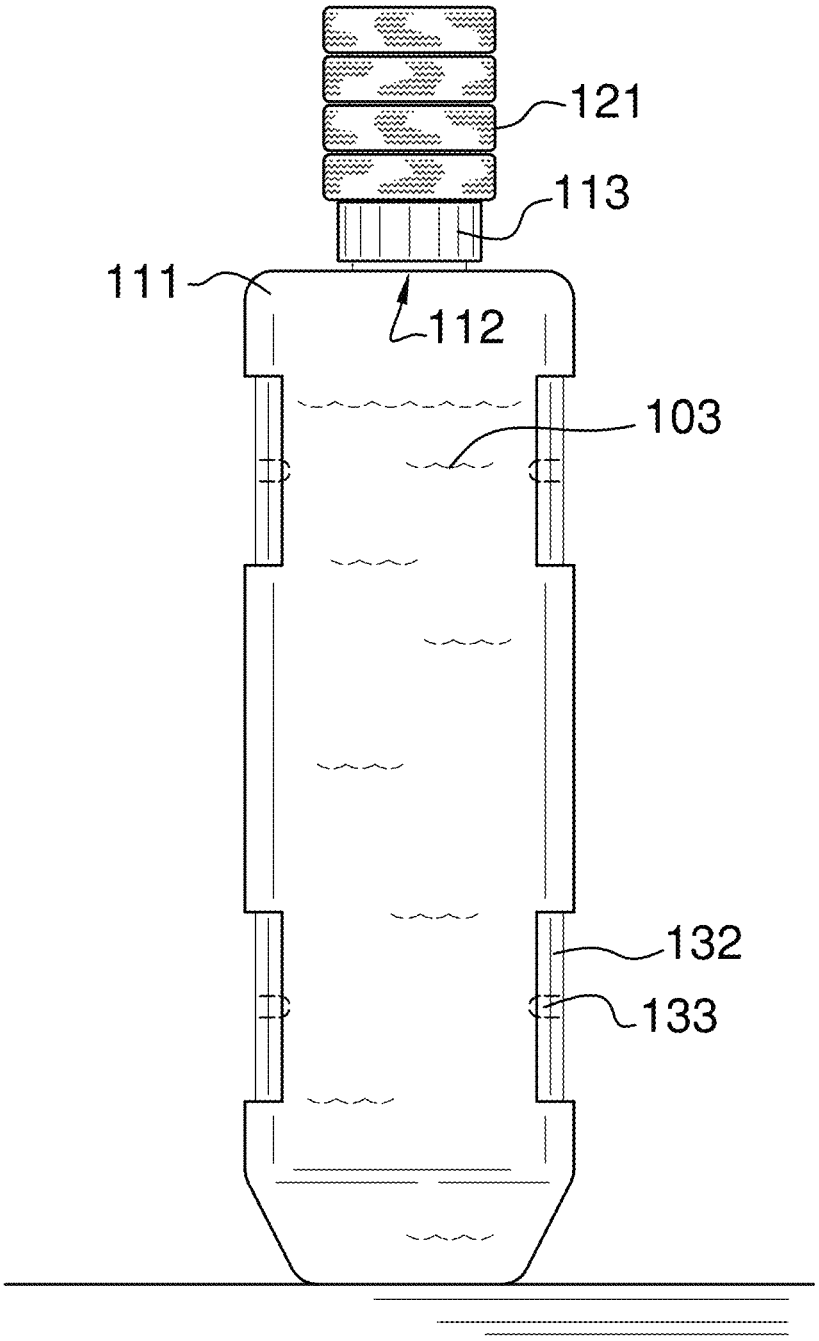
FIG. 5 is an in-use view of an embodiment of the disclosure.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. Detailed reference will now be made to one or more potential embodiments of the disclosure, which are illustrated in FIGS. 1 through 5.

The soap or shampoo bottle that converts into a toy 100 (hereinafter invention) is an entertainment. The invention 100 is a container. The invention 100 is configured for use in containing a liquid phase compound 103. The invention 100 comprises a bottle structure 101 and a plurality of decorative structures 102. The plurality of decorative structures 102 attach to the bottle structure 101. The liquid phase compound 103 is stored within the bottle structure 101.

The bottle structure 101 forms the primary structure of the invention 100. The bottle structure 101 forms the primary shape of the invention 100. The bottle structure 101 is a figurine.

The figurine is defined elsewhere in this disclosure. The bottle structure 101 presents a form factor that presents sentiment selected from the group consisting of a human, animal, natural, a manufactured object, or symbolic concept. The bottle structure 101 forms a container. The bottle structure 101 is a hollow structure. The bottle structure 101 forms a protected space. The bottle structure 101 contains the liquid phase compound 103 in the formed protected space. The bottle structure 101 is formed with the structure of a bottle. The bottle structure 101 comprises a bottle flask 111, a bottle neck 112, and a bottle cap 113.

The bottle flask 111 forms the flask of the bottle formed by of the bottle structure 101. The bottle flask 111 is a roughly prism shaped structure. The bottle flask 111 forms the primary shape of the bottle structure 101. The bottle flask 111 forms the protected space formed by the invention 100. The bottle flask 111 is a fluid impermeable structure. The bottle flask 111 forms the physical structure that stores the liquid phase compound 103. The bottle flask 111 forms the exterior surfaces on which the plurality of decorative structures 102 removably attach. The bottle flask 111 further comprises a plurality of flask faces 131, a plurality of wheel wells 132, a plurality of well mortises 133, and a windshield mount structure 134.

The plurality of flask faces 131 form the exterior surfaces of the protected space formed by the bottle flask 111. The plurality of flask faces 131 form the containment surfaces of the protected space formed by the bottle flask 111. Each decorative structure selected from the plurality of decorative structures 102 attaches to an exterior surface of a flask face selected from the plurality of flask faces 131. The plurality of flask faces 131 further comprises an anterior flask face 161, a posterior flask face 162, a superior lateral flask face 163, an inferior lateral flask face 164, a left lateral flask face 165, and a right lateral flask face 166.

The inferior lateral flask face 164 is the lateral face selected from the plurality of flask faces 131 with the perimeter bounded by the anterior flask face 161, the posterior flask face 162, the left lateral flask face 165, and the right lateral flask face 166. The inferior lateral flask face 164 is the lateral face selected from the plurality of flask faces 131 with the greatest surface area. The superior lateral flask face 163 is the lateral face selected from the plurality of flask faces 131 with the perimeter bounded by the anterior flask face 161, the posterior flask face 162, the left lateral flask face 165, and the right lateral flask face 166. The superior lateral flask face 163 is the lateral face selected from the plurality of flask faces 131 that is distal from the inferior lateral flask face 164.

The posterior flask face 162 is the lateral face selected from the plurality of flask faces 131 with the perimeter bounded by the superior lateral flask face 163, the inferior lateral flask face 164, the left lateral flask face 165, and the right lateral flask face 166. The posterior flask face 162 is the lateral face selected from the plurality of flask faces 131 with the least surface area. The anterior flask face 161 is the lateral face selected from the plurality of flask faces 131 with the perimeter bounded by the superior lateral flask face 163, the inferior lateral flask face 164, the left lateral flask face 165, and the right lateral flask face 166. The anterior flask face 161 is the lateral face selected from the plurality of flask faces 131 that is distal from the posterior flask face 162.

The right lateral flask face 166 is the lateral face selected from the plurality of flask faces 131 with the perimeter bounded by the anterior flask face 161, the posterior flask face 162, the superior lateral flask face 163, and the inferior lateral flask face 164. The right lateral flask face 166 is the lateral face selected from the plurality of flask faces 131 that forms the right side of the bottle flask 111. The left lateral flask face 165 is the lateral face selected from the plurality of flask faces 131 with the perimeter bounded by the anterior flask face 161, the posterior flask face 162, the superior lateral flask face 163, and the inferior lateral flask face 164. The left lateral flask face 165 is the lateral face selected from the plurality of flask faces 131 that is distal from the right lateral flask face 166.

Each wheel well selected from the plurality of wheel wells 132 is a negative space that is formed in exterior surface of the bottle flask 111. Each wheel well selected from the plurality of wheel wells 132 is identical. Each wheel well selected from the plurality of wheel wells 132 is formed with a rough semicircular shape. Each wheel well selected from the plurality of wheel wells 132 is formed at a location selected from the group consisting of: a) the exterior surface of the left lateral flask face 165 at the brink lip formed at the brink between the left lateral flask face 165 and the posterior flask face 162; and, b) the exterior surface of the right lateral flask face 166 at the brink lip formed at the brink between the right lateral flask face 166 and the posterior flask face 162.

Each well mortise selected from the plurality of well mortises 133 is a mortise. Each well mortise selected from the plurality of well mortises 133 is formed within a wheel well selected from the plurality of wheel wells 132. Each well mortise selected from the plurality of well mortises 133 is formed in a lateral face selected from the group consisting of: a) the left lateral flask face 165; and, b) the right lateral flask face 166. Each well mortise selected from the plurality of well mortises 133 forms an anchor point for a decorative structure selected from the plurality of decorative structures 102.

The windshield mount structure 134 is a mechanical structure. The windshield mount structure 134 forms an anchor point for a decorative structure selected from the plurality of decorative structures 102. The windshield mount structure 134 attaches to the superior lateral flask face 163 of the bottle flask 111.

The bottle neck 112 forms the neck of the bottle formed by of the bottle neck 112. The bottle neck 112 has a tubular structure. The bottle neck 112 forms a fluid port that: a) receives the liquid phase compound 103 into the protected space formed by the bottle flask 111; and b) discharges the liquid phase compound 103 from the protected space formed by the bottle flask 111. The bottle neck 112 is formed in the posterior flask face 162 of the bottle flask 111.

The bottle cap 113 forms a lid that encloses the open end of the tubular structure of the bottle neck 112 that is distal from the bottle flask 111 of the bottle structure 101. The bottle cap 113 is a fluid impermeable structure. The bottle cap 113 is geometrically similar to the bottle neck 112. The bottle cap 113 attaches to the bottle neck 112 with a tight fit. The bottle cap 113 attaches to the bottle neck 112 to form a fluid impermeable seal. The bottle cap 113 physically encloses the protected space formed by the bottle flask 111. In the first potential embodiment of the disclosure, the bottle cap 113 attaches to the bottle neck 112 with a threaded connection.

The bottle cap 113 further comprises a cap mortise 141. The cap mortise 141 is a mortise. The cap mortise 141 is a negative space that is formed in the closed face of the pan structure of the bottle cap 113. The cap mortise 141 forms an anchor point for a decorative structure selected from the plurality of decorative structures 102.

The plurality of decorative structures 102 combine to form an entertainment. The plurality of decorative structures 102 mount on the exterior surface of the bottle structure 101. The plurality of decorative structures 102 form a decorative structure that reinforces the sentiment presented by the form factor of the bottle structure 101. The plurality of decorative structures 102 removably attaches to the bottle structure 101. The plurality of decorative structures 102 comprises a plurality of decorative wheels 121 and a windshield pan structure 122.

Each individual decorative wheel 151 selected from the plurality of decorative wheels 121 is a decorative object. Each individual decorative wheel 151 selected from the plurality of decorative wheels 121 is identical. Each individual decorative wheel 151 selected from the plurality of decorative wheels 121 generates a sentiment of the wheel of a vehicle in a viewer. The plurality of decorative wheels 121 mount on the exterior surface of the bottle flask 111 such that the combined form factor of the plurality of decorative wheels 121 on the bottle flask 111 generates the sentiment of a vehicle. Each individual decorative wheel 151 selected from the plurality of decorative wheels 121 mounts in its associated wheel well selected from the plurality of wheel wells 132. Each selected individual decorative wheel 151 removably attaches to the bottle flask 111. Each selected individual decorative wheel 151 removably attaches to the bottle cap 113 for storage.

Each individual decorative wheel 151 selected from the plurality of decorative wheels 121 is geometrically similar to a wheel well selected from the plurality of wheel wells 132. Each individual decorative wheel 151 selected from the plurality of decorative wheels 121 is associated with a wheel well selected from the plurality of wheel wells 132. Each selected individual decorative wheel 151 is sized such that the selected individual decorative wheel 151 inserts into its associated selected wheel well. Each individual decorative wheel 151 selected from the plurality of decorative wheels 121 further comprises an individual disk structure 152. An individual tenon structure 153, and an individual disk mortise 154.

The individual disk structure 152 is a circular disk shaped structure. The individual disk structure 152 is associated with a wheel well selected from the plurality of wheel wells 132. The individual disk structure 152 inserts into the associated selected wheel well such that the selected wheel well partially encloses the perimeter of the individual disk structure 152.

The individual tenon structure 153 is a tenon. The individual tenon structure 153 attaches to a congruent end of the individual disk structure 152. The individual tenon structure 153 is a roughly prism shaped structure. The individual tenon structure 153 is geometrically similar to a well mortise selected from the plurality of well mortises 133. The individual tenon structure 153 is associated with the well mortise selected from the plurality of well mortises 133. The individual tenon structure 153 removably attaches the individual decorative wheel 151 to the bottle flask 111 by inserting into the selected well mortise with a tight fit. The individual tenon structure 153 is geometrically similar to the cap mortise 141 of the bottle cap 113. The individual tenon structure 153 removably attaches the individual decorative wheel 151 to the bottle cap 113 by inserting into the cap mortise 141 with a tight fit.

The individual disk mortise 154 is a mortise that is on the congruent end of the individual disk structure 152 that is distal from the individual tenon structure 153. The individual disk mortise 154 is geometrically similar to the individual tenon structure 153. The individual disk mortise 154 is sized such that the individual tenon structure 153 of a different individual decorative wheel 151 selected from the plurality of decorative wheels 121 inserts into the individual disk mortise 154 with a tight fit. The individual disk mortise 154 allows the plurality of decorative wheels 121 to be stacked into a single column that then attaches to the cap mortise 141 of the bottle cap 113.

The windshield pan structure 122 is a roughly pan shaped structure. The windshield pan structure 122 is a transparent structure. The windshield pan structure 122 removably attaches to the windshield mount structure 134 that is mounted on the superior lateral flask face 163 of the bottle flask 111. The windshield pan structure 122 generates a sentiment of the cab a vehicle. The windshield pan structure 122 mounts on the exterior surface of the bottle flask 111 such that the combined form factor of the windshield pan structure 122 on the bottle flask 111 generates the sentiment of a vehicle. The windshield pan structure 122 attaches to the windshield mount structure 134 with a tight fit.

The following definitions were used in this disclosure:

Align: As used in this disclosure, align refers to an arrangement of objects that are: 1) arranged in a straight plane or line; 2) arranged to give a directional sense of a plurality of parallel planes or lines; or, 3) a first line or curve is congruent to and overlaid on a second line or curve.

Aft: As used in this disclosure, aft is term that relates a first object to a second object. When the second object is closer to the stern of a vehicle, the second object is said to be aft of the first object. The term is commonly used on vessels and vehicles.

Anterior: As used in this disclosure, anterior is a term that is used to refer to the front side or direction of a structure. When comparing two objects, the anterior object is the object that is closer to the front of the structure.

Associate: As used in this disclosure, the term associate is used to describe a relationship between a first object and a second object. The use of the term associated implies both: a) that the first object works with the second object in order to accomplish a task necessary for the implementation of the invention (such as joining two objects together); and, b) the relationship remains stable through the accomplishment of the task. By stable is meant that neither the first object or the second object are intended to be interchanged with a third object during the use of the invention.

Barrier: As used in this disclosure, a barrier is a physical obstacle that forms a boundary between a first space and a second space. The barrier prevents the passage of an object between the first space and the second space.

Bifurcate: As used in this disclosure, to bifurcate means to divide an object or space into two pieces or segments. Bottle: As used in this disclosure, a bottle is a container used for the storage of fluids. A bottle generally comprises a flask and a neck. The flask is a pan shaped containment structure. The neck is a tubular structure that provides access to the interior of the flask. The neck comprises: a) a tube structure that forms an aperture through which fluids can be introduced and removed from the bottle; and, b) a physical structure that encloses the open face of the pan structure of the flask such that the inner dimension of the neck need not be identical to the inner dimension of the flask.

Bow: As used in this disclosure, the bow refers to the anterior side of an object, vehicle, or vessel. Specifically, the bow refers to the structure that leads the object, vehicle, or vessel into the primary sense of direction of the object vehicle, or vessel.

Brink: As used in this disclosure, a brink refers to the edge or line formed by the intersection of a first plane or surface and a second plane or surface wherein a cant exists between the first plane or surface and the second plane or surface.

Cant: As used in this disclosure, a cant is an angular deviation from one or more reference lines (or planes) such as a vertical line (or plane) or a horizontal line (or plane). Cavity: As used in this disclosure, a cavity is a negative space that is formed into but not through an object.

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or a prism. The center axis of a prism is the line that joins the center point of the first congruent face of the prism to the center point of the second corresponding congruent face of the prism. The center axis of a pyramid refers to a line formed through the apex of the pyramid that is perpendicular to the base of the pyramid. When the center axes of two cylinder, prism or pyramidal structures share the same line they are said to be aligned. When the center axes of two cylinder, prism or pyramidal structures do not share the same line they are said to be offset.

Composite Prism: As used in this disclosure, a composite prism refers to a structure that is formed from a plurality of structures selected from the group consisting of a prism structure, a pyramid structure, and a spherical structure. The plurality of selected structures may or may not be truncated or bifurcated. The plurality of prism structures are joined together such that the center axes of each of the plurality of structures are aligned. The congruent ends of any two structures selected from the group consisting of a prism structure and a pyramid structure need not be geometrically similar.

Congruent: As used in this disclosure, congruent is a term that compares a first object to a second object. Specifically, two objects are said to be congruent when: 1) they are geometrically similar; and, 2) the first object can superimpose over the second object such that the first object aligns, within manufacturing tolerances, with the second object. Container: As used in this disclosure, a container is a structure that forms a protected space (or protection space) used to store and transport an object. The term containment structure is a synonym for container. Use protected space or protection space.

Correspond: As used in this disclosure, the term correspond is used as a comparison between two or more objects wherein one or more properties shared by the two or more objects match, agree, or align within acceptable manufacturing tolerances.

Decorative: As used in this disclosure, decorative is an adjective that refers to a first object or item that is used with a second object or item for the purpose of making the second object or item more attractive. Decorative will generally, but not necessarily, implies making the second object or item more attractive visually.

Disk: As used in this disclosure, a disk is a prism-shaped object that is flat in appearance. The disk is formed from two congruent ends that are attached by a lateral face. The sum of the surface areas of two congruent ends of the prism-shaped object that forms the disk is greater than the surface area of the lateral face of the prism-shaped object that forms the disk. In this disclosure, the congruent ends of the prism-shaped structure that forms the disk are referred to as the faces of the disk.

Elevation: As used in this disclosure, elevation refers to the span of the distance in the superior direction between a specified horizontal surface and a reference horizontal surface. Unless the context of the disclosure suggest otherwise, the specified horizontal surface is the supporting surface the potential embodiment of the disclosure rests on. The infinitive form of elevation is to elevate.

Entertain: As used in this disclosure, to entertain means to attract and hold the attention of one or more individuals. The term entertainment refers to the method use to attract and maintain the attention of the one or more individuals.

Environment: As used in this disclosure, an environment refers to the physical conditions surrounding an object. The term environment is often limited to the physical conditions that the object interacts with.

Exterior: As used in this disclosure, the exterior is used as a relational term that implies that an object is not contained within the boundary of a structure or a space. Figurine: As used in this disclosure, a figurine is a three dimensional structure resembling (or representing) a human, animal, natural, or symbolic sentiment.

Fitted: As used in this disclosure, the term fitted refers to two geometrically similar structures wherein the smaller geometrically similar structure inserts into the larger geometrically similar structure.

Flow: As used in this disclosure, a flow refers to the passage of a fluid past a fixed point. This definition considers bulk solid materials as capable of flow.

Fluid: As used in this disclosure, a fluid refers to a state of matter wherein the matter is capable of flow and takes the shape of a container it is placed within. The term fluid commonly refers to a liquid or a gas.

Fluid Impermeable: As used in this disclosure, the term fluid impermeable refers to: a) the ability of a structure to not allow a fluid to pass through the structure; or, b) the ability of a material not absorb through the exterior surfaces of the material a fluid that the material is immersed in or exposed to.

Force of Gravity: As used in this disclosure, the force of gravity refers to a vector that indicates the direction of the pull of gravity on an object at or near the surface of the earth.

Form Factor: As used in this disclosure, the term form factor refers to the size and shape of an object.

Forward: As used in this disclosure, forward is a term that relates a first object to a second object. When the first object is closer to the bow of a vehicle, the first object is said to be forward of the second object. The term is commonly used on vessels and vehicles.

Friction: As used in this disclosure, friction refers to a force that occurs between two objects that are in relative motion while in contact with each other. The force resists the relative motion of the two objects. More technically, friction refers to an exchange of energy between two objects that are in contact with each other that converts the energy of a directed relative motion between the two objects into randomly directed motions of the molecules that form both objects.

Gas: As used in this disclosure, a gas refers to a state (phase) of matter that is fluid and that fills the volume of the structure that contains it. Stated differently, the volume of a gas always equals the volume of its container.

Geometrically Similar: As used in this disclosure, geometrically similar is a term that compares a first object to a second object wherein: 1) the sides of the first object have a one to one correspondence to the sides of the second object; 2) wherein the ratio of the length of each pair of corresponding sides are equal; 3) the angles formed by the first object have a one to one correspondence to the angles of the second object; and, 4) wherein the corresponding angles are equal. The term geometrically identical refers to a situation where the ratio of the length of each pair of corresponding sides equals 1. By the term essentially geometrically similar is meant that the primary shapes of two objects are geometrically similar except that there are functional items (such as fastening devices) associated with the primary shape may not maintain the ratio for geometric similarity. By the term roughly geometrically similar is meant that the form factors between the primary shape of the two objects can vary by a factor of up to 10% when the two objects are normalized to be roughly geometrically identical. Horizontal: As used in this disclosure, horizontal is a directional term that refers to a direction that is either: 1) parallel to the horizon; 2) perpendicular to the local force of gravity, or, 3) parallel to a supporting surface. In cases where the appropriate definition or definitions are not obvious, the second option should be used in interpreting the specification. Unless specifically noted in this disclosure, the horizontal direction is always perpendicular to the vertical direction.

Inferior: As used in this disclosure, the term inferior refers to a directional reference that is parallel to and in the same direction as the force of gravity when an object is positioned or used normally.

Interior: As used in this disclosure, the interior is used as a relational term that implies that an object is contained within the boundary of a structure or a space.

Lateral: As used in this disclosure, the term lateral refers to the movement of an object that is perpendicular to the primary sense of direction of an object and parallel to the horizontal plane (or perpendicular to the vertical plane). Lateral movement is always perpendicular to the anterior posterior axis. Lateral movement is often called sideways movement.

Left and Right: As used in this disclosure, the terms left and right are directional references associated with an object. The object is further defined with an anterior surface and a posterior surface. The terms left and right are standardized naming conventions for the lateral directions of the object. The terms left and right use the human body for the initial definition of the orientation. Specifically, when a human body is viewed from posterior side towards the anterior side, the left side of the human body is the lateral side of the human body that contains the heart. The right side of the human body is the lateral side of the body that contains the bulk of the liver. The left and right sides of the human body remain unchanged by changes to the direction from which the human body is viewed. The left side of any object is the same side as the left side of the human body when the object is viewed from posterior side towards the anterior side. The right side of any object is the same side as the right side of the human body when the object is viewed from posterior side towards the anterior side. The left and right sides of the object remain unchanged by changes to the direction from which the object is viewed.

Lip: As used in this disclosure, a lip refers to the region of the lateral face of a pan or tube structure that abuts the perimeter of the open face of the pan or tube structure. By abutting the perimeter of the open face is meant that the lip forms a brink with the surface that forms the perimeter of the open face. The lip of the interior surface of the pan structure is called the interior lip. The lip of the exterior surface of the pan structure is called the exterior lip. The region of the lateral face of a pan structure that abuts the perimeter of the closed face of the pan structure is called the brink lip. Liquid: As used in this disclosure, a liquid refers to a state (phase) of matter that is fluid and that maintains, for a given pressure, a fixed volume that is independent of the volume of the container.

Load: As used in this disclosure, the term load refers to an object upon which a force is acting or which is otherwise absorbing energy in some fashion. Examples of a load in this sense include, but are not limited to, a mass that is being moved a distance or an electrical circuit element that draws energy. The term load is also commonly used to refer to the forces that are applied to a stationary structure. Load Path: As used in this disclosure, a load path refers to a chain of one or more structures that transfers a load generated by a raised structure or object to a foundation, supporting surface, or the earth.

Mortise: As used in this disclosure, a mortise is a negative space formed in a material that is designed to receive a similarly shaped object such that the similarly shaped object is flush to the interior surfaces of the formed by the mortise. Frictional forces between the mortise and the tenon are often used to secure the tenon within the mortise.

Negative Space: As used in this disclosure, negative space is a method of defining an object through the use of open or empty space as the definition of the object itself, or, through the use of open or empty space to describe the boundaries of an object.

Not Significantly Different: As used in this disclosure, the term not significantly different compares a specified property of a first object to the corresponding property of a reference object (reference property). The specified property is considered to be not significantly different from the reference property when the absolute value of the difference between the specified property and the reference property is less than 10.0% of the reference property value. A negligible difference is considered to be not significantly different.

One to One: When used in this disclosure, a one to one relationship means that a first element selected from a first set is in some manner connected to only one element of a second set. A one to one correspondence means that the one to one relationship exists both from the first set to the second set and from the second set to the first set. A one to one fashion means that the one to one relationship exists in only one direction. In a one to one correspondence, the first element of the first set is said to be associated to the second element of the second set to which the first element corresponds.

Pan: As used in this disclosure, a pan is a hollow containment structure. The pan has a shape selected from the group consisting of: a) a prism; and, b) a truncated pyramid. The pan has a single open face. The open face of the pan is often, but not always, the superior face of the pan. The open face is a surface selected from the group consisting of: a) a congruent end of the prism structure that forms the pan; b) a lateral face of the prism structure that forms the pan, c) the base face of the truncated pyramid structure; and, d) the truncated face of the truncated pyramid structure. A semi-enclosed pan refers to a pan wherein the closed end of prism structure of the pan and/or a portion of the lateral face of the pan is also open. Pedestal: As used in this disclosure, a pedestal is an intermediary load bearing structure that forms a load path between two objects or structures.

Perimeter: As used in this disclosure, a perimeter is one or more curved or straight lines that bounds an enclosed area on a plane or surface. The perimeter of a circle is commonly referred to as a circumference.

Phase: As used in this disclosure, phase refers to the state of the form of matter. The common states of matter are solid, liquid, gas, and plasma.

Posterior: As used in this disclosure, posterior is a term that is used to refer to the side of an object that is distal or in the opposite direction of the anterior side. When comparing two items, the posterior item is the item that is distal from the anterior of the object.

Primary Sense of Direction: As used in this disclosure, the primary sense of direction of an object refers to a vector that: 1) passes through the center of the object; and, 2) is parallel to the direction of travel when the anterior surface(s) of the object are leading the object into the direction of travel. This definition intends to align with what people would normally call the forward direction of an object.

Primary Shape: As used in this disclosure, the primary shape refers to a description of the rough overall geometric shape of an object that is assembled from multiple components or surfaces. The term essential primary shape is used to indicate the exclusion of functional items that are attached to the structure of the primary shape.

Primary Structure: As used in this disclosure, a primary structure refers to the component of an object that the other components attach to. The primary structure is also called the base structure.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Protected Space: As used in this disclosure, a protected space is a negative space within which an object is stored. The protected space is enclosed by a barrier structure that: a) prevents damage to the object contained within the protected space; b) maintains conditions that are appropriate for the object; c) protects the object within the protected space from potential dangers that are outside of the protected space; or, d) maintains the privacy of the object within the protected space.

Puppet: As used in this disclosure, a puppet is a three-dimensional figure resembling a human, animal or symbolic image. A puppet is often called a doll.

Roughly: As used in this disclosure, roughly refers to a comparison between two objects. Roughly means that the difference between one or more parameters of the two compared objects are not significantly different.

Semicircle: As used in this disclosure, a semicircle refers to a planar structure that is formed as one-half of a circle. The circle that forms the semicircle is bisected by a line that passes through the center point of the circle.

Sentiment: As used in this disclosure, a sentiment refers to a symbolic meaning or message that is communicated through the use of an object or an image, potentially including a text based image.

Snap: As used in this disclosure, a snap is a fastener that comprises a first component and a second component. The snap is engaged by pressing the first component into or against the second component.

Solid: As used in this disclosure, a solid refers to a state (phase) of matter that: 1) has a fixed volume; and, 2) does not flow.

Stern: As used in this disclosure, the stern refers to the posterior side of an object, vehicle, or vessel. The stern is distal from the bow along the primary sense of direction.

Superior: As used in this disclosure, the term superior refers to a directional reference that is parallel to and in the opposite direction of the force of gravity when an object is positioned or used normally.

Supporting Surface: As used in this disclosure, a supporting surface is a horizontal surface upon which an object is placed and to which the load of the object is transferred. This disclosure assumes that an object placed on the supporting surface is in an orientation that is appropriate for the normal or anticipated use of the object.

Tenon: As used in this disclosure, a tenon is a structure that projects away from an edge a first object (often the end of a piece of wood). The tenon is sized and shaped to fit into a mortise that is formed in a second object such that the first object can be attached to the second object by inserting the tenon in the matching mortise.

Tight Fit: As used in this disclosure, a tight fit refers to the insertion of a first object into a second object such that there is not a lot of space between the first object and the second object. By not a lot of space is meant that friction occurs when the first object moves within the second object.

Threaded Connection: As used in this disclosure, a threaded connection is a type of fastener that is used to join a first cylindrical object and a second cylindrical object together. The first cylindrical object is fitted with a first fitting selected from an interior screw thread or an exterior screw thread. The second cylindrical object is fitted with the remaining screw thread. The cylindrical object fitted with the exterior screw thread is placed into the remaining cylindrical object such that: 1) the interior screw thread and the exterior screw thread interconnect; and, 2) when the cylindrical object fitted with the exterior screw thread is rotated the rotational motion is converted into linear motion that moves the cylindrical object fitted with the exterior screw thread either into or out of the remaining cylindrical object. The direction of linear motion is determined by the direction of rotation. A note on usage: when fastening two objects the exterior screw thread of the threaded connection can be formed on a first object and the matching interior screw thread of the threaded connection can be formed in a second object without significant regard as to which object of the two objects is the first object and which of the two objects is the second object. When the assignment of the type of screw thread does not provide a significant technical advantage, the screw thread assigned to the first object will simply be referred to as the "exterior/interior screw thread" with the understanding that when the two objects are fastened together one of the two objects will have an exterior screw thread and the remaining object will have an interior screw thread.

Toy: As used in this disclosure, a toy is a physical object used to entertain or distract an individual or an animal.

Tube: As used in this disclosure, a tube is a hollow prism-shaped device formed with two open congruent ends. The tube is used for transporting liquids (including bulk solids) and gases. The line that connects the center of the first congruent face of the prism to the center of the second congruent face of the prism is referred to as the center axis of the tube or the centerline of the tube. When two tubes share the same centerline they are said to be aligned. When the centerlines of two tubes are perpendicular to each other, the tubes are said to be perpendicular to each other. In this disclosure, the terms inner dimensions of a tube and outer dimensions of a tube are used as they would be used by those skilled in the plumbing arts.

Vehicle: As used in this disclosure, a vehicle is a device that is used for transporting passengers, goods, or equipment. The term motorized vehicle specifically refers to a vehicle can move under power provided by an electric motor or an internal combustion engine. The term vehicle generically applies to motorized vehicles and vehicles without a motor. A motorized vehicle further comprises an electrical system that can be used as a source of electric energy. The enclosed passenger space of a vehicle is known as a cab.

Vertical: As used in this disclosure, vertical refers to a direction that is either: 1) perpendicular to the horizontal direction; 2) parallel to the local force of gravity; or, 3) when referring to an individual object the direction from the designated top of the individual object to the designated bottom of the individual object. In cases where the appropriate definition or definitions are not obvious, the second option should be used in interpreting the specification. Unless specifically noted in this disclosure, the vertical direction is always perpendicular to the horizontal direction.

Wheel: As used in this disclosure, a wheel is a circular object that revolves around an axle or an axis and is fixed below an object to enable it to move easily over the ground. For the purpose of this disclosure, it is assumed that a wheel can only revolve in a forward and a backward direction. Wheels are often further defined with a rim and spokes. Spokes are also commonly referred to as a wheel disk.

Windshield: As used in this disclosure, a windshield refers to the front and rear window of a vehicle that is intended to shield the occupants of the vehicle from the wind generated by the normal motion of the vehicle. Windscreen is a synonym for windshield.

With respect to the above description, it is to be realized that the optimum dimensional relationship for the various components of the invention described above and in FIGS. 1 through 5 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A soap or shampoo bottle that converts into a toy comprising:

a bottle structure and a plurality of decorative structures;
wherein the plurality of decorative structures attach to the bottle structure;
wherein the bottle structure is a figurine;
wherein the bottle structure forms a container;
wherein the bottle structure comprises a bottle flask, a bottle neck, and a bottle cap;
wherein the plurality of decorative structures comprises a plurality of decorative wheels and a windshield pan structure;
wherein each individual decorative wheel selected from the plurality of decorative wheels is a decorative object;
wherein each individual decorative wheel selected from the plurality of decorative wheels is identical;
wherein each individual decorative wheel selected from the plurality of decorative wheels mounts in an associated wheel well selected from a plurality of wheel wells;
wherein each selected individual decorative wheel removably attaches to the bottle flask;
wherein the windshield pan structure removably attaches to a windshield mount structure that is mounted on a superior lateral flask face of the bottle flask.

2. The soap or shampoo bottle that converts into a toy according to claim 1 wherein the soap or shampoo bottle is an entertainment;
wherein the soap or shampoo bottle that converts into a toy is a container;
wherein the soap or shampoo bottle that converts into a toy is configured for use with a liquid phase compound;
wherein the liquid phase compound is stored within the bottle structure.

3. The soap or shampoo bottle that converts into a toy according to claim 2 wherein the bottle structure forms the primary structure of the soap or shampoo bottle that converts into a toy;

wherein the bottle structure forms the primary shape of the soap or shampoo bottle that converts into a toy;
wherein the bottle structure is a hollow structure;
wherein the bottle structure forms a protected space;
wherein the bottle structure contains the liquid phase compound in the formed protected space.

4. The soap or shampoo bottle that converts into a toy according to claim 3 wherein the plurality of decorative structures combine to form an entertainment;
wherein the plurality of decorative structures mount on the exterior surface of the bottle structure;
wherein the plurality of decorative structures form a decorative structure that reinforces the sentiment presented by the form factor of the bottle structure;
wherein the plurality of decorative structures removably attaches to the bottle structure.

5. The soap or shampoo bottle that converts into a toy according to claim 4 wherein the bottle structure is formed with the structure of a bottle;
wherein the bottle neck attaches to the bottle flask;
wherein the bottle cap attaches to the bottle neck.

6. The soap or shampoo bottle that converts into a toy according to claim 5 wherein the bottle flask forms the flask of the bottle formed by of the bottle structure;
wherein the bottle flask forms the primary shape of the bottle structure;
wherein the bottle flask forms the protected space formed by the soap or shampoo bottle that converts into a toy;
wherein the bottle flask is a fluid impermeable structure;
wherein the bottle flask forms the physical structure that stores the liquid phase compound;
wherein the bottle flask forms the exterior surfaces on which the plurality of decorative structures removably attach.

7. The soap or shampoo bottle that converts into a toy according to claim 6 wherein the bottle neck forms the neck of the bottle formed by of the bottle neck;
wherein the bottle neck has a tubular structure;
wherein the bottle neck forms a fluid port that: a) receives the liquid phase compound into the protected space formed by the bottle flask; and b) discharges the liquid phase compound from the protected space formed by the bottle flask;
wherein the bottle cap forms a lid that encloses the open end of the tubular structure of the bottle neck that is distal from the bottle flask of the bottle structure;
wherein the bottle cap is a fluid impermeable structure;
wherein the bottle cap is geometrically similar to the bottle neck;
wherein the bottle cap attaches to the bottle neck with a tight fit;

wherein the bottle cap attaches to the bottle neck to form a fluid impermeable seal;

wherein the bottle cap physically encloses the protected space formed by the bottle flask.

8. The soap or shampoo bottle that converts into a toy according to claim 7 wherein the bottle flask further comprises a plurality of flask faces, the plurality of wheel wells, a plurality of well mortises, and a windshield mount structure;

wherein the plurality of wheel wells, the plurality of well mortises, and the windshield mount structure attach to the plurality of flask faces.

9. The soap or shampoo bottle that converts into a toy according to claim 8 wherein the plurality of flask faces form the exterior surfaces of the protected space formed by the bottle flask;

wherein the plurality of flask faces form the containment surfaces of the protected space formed by the bottle flask;

wherein each decorative structure selected from the plurality of decorative structures attaches to an exterior surface of a flask face selected from the plurality of flask faces;

wherein each wheel well selected from the plurality of wheel wells is a negative space that is formed in exterior surface of the bottle flask;

wherein each wheel well selected from the plurality of wheel wells is identical;

wherein each wheel well selected from the plurality of wheel wells is formed with a rough semicircular shape;

wherein each well mortise selected from the plurality of well mortises is a mortise;

wherein each well mortise selected from the plurality of well mortises is formed within a wheel well selected from the plurality of wheel wells;

wherein each well mortise selected from the plurality of well mortises forms an anchor point for a decorative structure selected from the plurality of decorative structures;

wherein the windshield mount structure is a mechanical structure;

wherein the windshield mount structure forms an anchor point for a decorative structure selected from the plurality of decorative structures.

10. The soap or shampoo bottle that converts into a toy according to claim 9 wherein the plurality of flask faces further comprises an anterior flask face, a posterior flask face, the superior lateral flask face, an inferior lateral flask face, a left lateral flask face, and a right lateral flask face;

wherein the inferior lateral flask face is the lateral face selected from the plurality of flask faces with the perimeter bounded by the anterior flask face, the posterior flask face, the left lateral flask face, and the right lateral flask face;

wherein the inferior lateral flask face is the lateral face selected from the plurality of flask faces with the greatest surface area;

wherein the superior lateral flask face is the lateral face selected from the plurality of flask faces with the perimeter bounded by the anterior flask face, the posterior flask face, the left lateral flask face, and the right lateral flask face;

wherein the superior lateral flask face is the lateral face selected from the plurality of flask faces that is distal from the inferior lateral flask face;

wherein the posterior flask face is the lateral face selected from the plurality of flask faces with the perimeter bounded by the superior lateral flask face, the inferior lateral flask face, the left lateral flask face, and the right lateral flask face;

wherein the posterior flask face is the lateral face selected from the plurality of flask faces with the least surface area;

wherein the anterior flask face is the lateral face selected from the plurality of flask faces with the perimeter bounded by the superior lateral flask face, the inferior lateral flask face, the left lateral flask face, and the right lateral flask face;

wherein the anterior flask face is the lateral face selected from the plurality of flask faces that is distal from the posterior flask face;

wherein the right lateral flask face is the lateral face selected from the plurality of flask faces with the perimeter bounded by the anterior flask face, the posterior flask face, the superior lateral flask face, and the inferior lateral flask face;

wherein the right lateral flask face is the lateral face selected from the plurality of flask faces that forms the right side of the bottle flask;

wherein the left lateral flask face is the lateral face selected from the plurality of flask faces with the perimeter bounded by the anterior flask face, the posterior flask face, the superior lateral flask face, and the inferior lateral flask face;

wherein the left lateral flask face is the lateral face selected from the plurality of flask faces that is distal from the right lateral flask face.

11. The soap or shampoo bottle that converts into a toy according to claim 10 wherein each wheel well selected from the plurality of wheel wells is formed at a location selected from the group consisting of: a) the exterior surface of the left lateral flask face at the brink lip formed at the brink between the left lateral flask face and the posterior flask face; and, b) the exterior surface of the right lateral flask face at the brink lip formed at the brink between the right lateral flask face and the posterior flask face;

wherein each well mortise selected from the plurality of well mortises is formed in a lateral face selected from the group consisting of: a) the left lateral flask face; and, b) the right lateral flask face;

wherein the windshield mount structure attaches to the superior lateral flask face of the bottle flask;

wherein the bottle neck is formed in the posterior flask face of the bottle flask.

12. The soap or shampoo bottle that converts into a toy according to claim 11 wherein the bottle cap further comprises a cap mortise;

wherein the cap mortise is a mortise;

wherein the cap mortise is a negative space that is formed in the closed face of the pan structure of the bottle cap;

wherein the cap mortise forms an anchor point for a decorative structure selected from the plurality of decorative structures.

13. The soap or shampoo bottle that converts into a toy according to claim 12 wherein each selected individual decorative wheel removably attaches to the bottle cap for storage;

wherein each individual decorative wheel selected from the plurality of decorative wheels is geometrically similar to a wheel well selected from the plurality of wheel wells;

wherein each individual decorative wheel selected from the plurality of decorative wheels is associated with a wheel well selected from the plurality of wheel wells;

wherein each selected individual decorative wheel is sized such that the selected individual decorative wheel inserts into its associated selected wheel well;

wherein the windshield pan structure is a roughly pan shaped structure;

wherein the windshield pan structure is a transparent structure;

wherein the windshield pan structure attaches to the windshield mount structure with a tight fit.

14. The soap or shampoo bottle that converts into a toy according to claim 13 wherein each individual decorative wheel selected from the plurality of decorative wheels further comprises an individual disk structure;

wherein an individual tenon structure, and an individual disk mortise;

wherein the individual disk structure is a circular disk shaped structure;

wherein the individual disk structure is associated with a wheel well selected from the plurality of wheel wells;

wherein the individual disk structure inserts into the associated selected wheel well such that the selected wheel well partially encloses the perimeter of the individual disk structure;

wherein the individual tenon structure is a tenon;

wherein the individual tenon structure attaches to a congruent end of the individual disk structure;

wherein the individual tenon structure is geometrically similar to a well mortise selected from the plurality of well mortises;

wherein the individual tenon structure is associated with the well mortise selected from the plurality of well mortises;

wherein the individual tenon structure removably attaches the individual decorative wheel to the bottle flask by inserting into the selected well mortise with a tight fit;

wherein the individual tenon structure is geometrically similar to the cap mortise of the bottle cap;

wherein the individual tenon structure removably attaches the individual decorative wheel to the bottle cap by inserting into the cap mortise with a tight fit;

wherein the individual disk mortise is a mortise that is on the congruent end of the individual disk structure that is distal from the individual tenon structure;

wherein the individual disk mortise is geometrically similar to the individual tenon structure;

wherein the individual disk mortise is sized such that the individual tenon structure of a different individual decorative wheel selected from the plurality of decorative wheels inserts into the individual disk mortise with a tight fit;

wherein the individual disk mortise allows the plurality of decorative wheels to be stacked into a single column that then attaches to the cap mortise of the bottle cap.

* * * * *